US011664600B2

(12) United States Patent
Wu et al.

(10) Patent No.: US 11,664,600 B2
(45) Date of Patent: May 30, 2023

(54) MULTI-BAND BASE STATION ANTENNAS HAVING INTEGRATED ARRAYS

(71) Applicant: CommScope Technologies LLC, Hickory, NC (US)

(72) Inventors: Bo Wu, Suzhou (CN); Martin L. Zimmerman, Chicago, IL (US); Björn Lindmark, Sollentuna (SE); Hangsheng Wen, Suzhou (CN); PuLiang Tang, Suzhou (CN); Jian Zhang, Suzhou (CN); Xun Zhang, Suzhou (CN); Ligang Wu, Suzhou (CN); Zhigang Wang, Suzhou (CN); Ruixin Su, Suzhou (CN); Maosheng Liu, Suzhou (CN); Rui An, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/526,488

(22) Filed: Nov. 15, 2021

(65) Prior Publication Data

US 2022/0077587 A1 Mar. 10, 2022

Related U.S. Application Data

(63) Continuation of application No. 16/829,148, filed on Mar. 25, 2020, now Pat. No. 11,205,852.

(30) Foreign Application Priority Data

Apr. 4, 2019 (CN) ..... 201910268246.X

(51) Int. Cl.
*H01Q 9/06* (2006.01)
*H01Q 5/321* (2015.01)
(Continued)

(52) U.S. Cl.
CPC ..... *H01Q 9/065* (2013.01); *H01Q 1/405* (2013.01); *H01Q 5/321* (2015.01); *H01Q 19/10* (2013.01); *H01Q 21/30* (2013.01)

(58) Field of Classification Search
CPC ..... H01Q 9/065; H01Q 1/405; H01Q 5/321; H01Q 19/10; H01Q 21/30; H01Q 5/42;
(Continued)

(56) References Cited

U.S. PATENT DOCUMENTS 9,935,698 B1 4/2018 Yang et al.
10,218,046 B2 2/2019 Hendrix et al.
(Continued)

FOREIGN PATENT DOCUMENTS

CN 108461927 A 8/2018
CN 208209011 U * 12/2018 ..... H01Q 19/10
(Continued)

OTHER PUBLICATIONS

Extended European Search Report for corresponding European Application No. 20167105.4 (10 pages) (dated Sep. 10, 2020).
(Continued)

*Primary Examiner* — Hoang V Nguyen
(74) *Attorney, Agent, or Firm* — Myers Bigel, P.A.

(57) ABSTRACT

Base station antennas are provided herein. A base station antenna includes a plurality of vertical columns of low-band radiating elements configured to transmit RF signals in a first frequency band. The base station antenna also includes a plurality of vertical columns of high-band radiating elements configured to transmit RF signals in a second frequency band that is higher than the first frequency band. The vertical columns of high-band radiating elements extend in parallel with the vertical columns of low-band radiating elements in a vertical direction.

17 Claims, 16 Drawing Sheets

(51) Int. Cl.
*H01Q 1/40* (2006.01)
*H01Q 19/10* (2006.01)
*H01Q 21/30* (2006.01)

(58) Field of Classification Search
CPC ..... H01Q 1/246; H01Q 21/08; H01Q 21/26; H01Q 1/42; H01Q 9/28
See application file for complete search history.

(56) References Cited

U.S. PATENT DOCUMENTS

| | | | |
|---|---|---|---|
| 2015/0009078 | A1 | 1/2015 | Sun et al. |
| 2016/0172757 | A1 | 6/2016 | Gottl |
| 2018/0026379 | A1 | 1/2018 | Barker et al. |

FOREIGN PATENT DOCUMENTS

| | | | | |
|---|---|---|---|---|
| CN | 208209011 | U | 12/2018 | |
| CN | 109462014 | A | 3/2019 | |
| WO | WO-2016081036 | A1 * | 5/2016 | ..... H01Q 1/523 |
| WO | WO-2018140305 | A1 * | 8/2018 | ..... H01Q 1/22 |
| WO | 2018209577 | A1 | 11/2018 | |

OTHER PUBLICATIONS

European Office Action for corresponding EP Application No. 20167105.4 (10 pages) (dated Jan. 23, 2023).

* cited by examiner

MULTI-BAND BASE STATION ANTENNAS HAVING INTEGRATED ARRAYS

CROSS-REFERENCE TO PRIORITY APPLICATION

The present application is a continuation of U.S. patent application Ser. No. 16/829,148, filed Mar. 25, 2020, which claims priority to Chinese Patent Application No. 201910268246.X, filed Apr. 4, 2019, the entire content of each of which is incorporated herein by reference.

FIELD

The present disclosure relates to communication systems and, in particular, to multi-band base station antennas.

BACKGROUND

Base station antennas for wireless communication systems are used to transmit Radio Frequency ("RF") signals to, and receive RF signals from, fixed and mobile users of a cellular communications service. Base station antennas often include a linear array or a two-dimensional array of radiating elements, such as dipole, or crossed dipole, radiating elements.

Example base station antennas are discussed in International Publication No. WO 2017/165512 to Bisiules and U.S. patent application Ser. No. 15/921,694 to Bisiules et al., the disclosures of which are hereby incorporated herein by reference in their entireties. Though it may be advantageous to incorporate multiple arrays of radiating elements in a single base station antenna, wind loading and other considerations often limit the number of arrays of radiating elements that can be included in a base station antenna.

SUMMARY

A base station antenna, according to some embodiments herein, may include a reflector. The base station antenna may include first and second vertical columns of low-band radiating elements on a surface of the reflector and configured to transmit RF signals in a first frequency band. Moreover, the base station antenna may include eight vertical columns of high-band radiating elements on the surface of the reflector and configured to transmit RF signals in a second frequency band that is higher than the first frequency band. A dipole arm of one of the low-band radiating elements may overlie one of the high-band radiating elements in a direction that is perpendicular to the surface of the reflector.

In some embodiments, the first and second vertical columns of low-band radiating elements may be first and second outer columns, respectively, of low-band radiating elements. Moreover, the first and second outer columns of low-band radiating elements may be between outer ones of the eight vertical columns of high-band radiating elements.

According to some embodiments, the eight vertical columns of high-band radiating elements may have equal quantities of high-band radiating elements. For example, each of the eight vertical columns of high-band radiating elements may have sixteen high-band radiating elements.

In some embodiments, first and second vertical columns of the eight vertical columns of high-band radiating elements may be between the first and second vertical columns of low-band radiating elements. Feed points of the first vertical column of low-band radiating elements may be spaced apart from feed points of the second vertical column of low-band radiating elements by a horizontal distance equal to 0.4-0.8 of a wavelength of the first frequency band. Moreover, feed points of the first vertical column of the eight vertical columns of high-band radiating elements may be staggered relative to feed points of the second vertical column of the eight vertical columns of high-band radiating elements.

A base station antenna, according to some embodiments herein, may include a reflector. The base station antenna may include first and second vertical columns of low-band radiating elements on a surface of the reflector and configured to transmit RF signals in a first frequency band. The base station antenna may include four vertical columns of high-band radiating elements on the surface of the reflector and configured to transmit RF signals in a second frequency band that is higher than the first frequency band. A horizontal distance between a feed point of the first vertical column of low-band radiating elements and a feed point of the second vertical column of low-band radiating elements may be about 225 millimeters or narrower.

In some embodiments, feed points of a first of the four vertical columns of high-band radiating elements may be staggered relative to feed points of a second of the four vertical columns of high-band radiating elements. Moreover, the feed point of the first vertical column of low-band radiating elements may be staggered relative to the feed point of the second vertical column of low-band radiating elements. The feed point of the first vertical column of low-band radiating elements may be aligned in a horizontal direction with one of the feed points of the second of the four vertical columns of high-band radiating elements.

According to some embodiments, a dipole arm of one of the low-band radiating elements may overlie one of the high-band radiating elements in a direction that is perpendicular to the surface of the reflector. Moreover, the dipole arm of the one of the low-band radiating elements may have a length equal to about half of a wavelength of the first frequency band.

In some embodiments, the first and second vertical columns of low-band radiating elements may be first and second outer columns, respectively, of low-band radiating elements. A feed point of a first outer one of the four vertical columns of high-band radiating elements may be spaced apart from a feed point of a second outer one of the four vertical columns of high-band radiating elements by the horizontal distance of about 225 millimeters or narrower. Moreover, the feed point of the first vertical column of low-band radiating elements may be aligned in a vertical direction with the feed point of the first outer one of the four vertical columns of high-band radiating elements.

According to some embodiments, the base station antenna may include a power divider that is coupled to each of the four vertical columns of high-band radiating elements. Additionally or alternatively, each of the four vertical columns of high-band radiating elements may be individually fed.

In some embodiments, the base station antenna may include a radome. The low-band radiating elements and the high-band radiating elements may be inside the radome, and the low-band radiating elements may extend forward from the surface of the reflector toward a front side of the radome. Moreover, the base station antenna may include a low-band connector on a back side of the radome that is opposite the front side. The low-band connector may be electrically coupled to one or more of the low-band radiating elements.

According to some embodiments, the low-band connector may be a 90-degree connector. Moreover, the base station antenna may include a blind mate high-band connector that is on the back side of the radome and is electrically coupled to one or more of the high-band radiating elements.

In some embodiments, the base station antenna may include first and second pluralities of high-band connection ports on the back side of the radome. The four vertical columns of high-band radiating elements may include a first array of high-band radiating elements electrically coupled to the first plurality of high-band connection ports and configured to transmit RF signals in a first sub-band of the second frequency band. Moreover, the four vertical columns of high-band radiating elements may include a second array of high-band radiating elements electrically coupled to the second plurality of high-band connection ports and configured to transmit RF signals in a second sub-band of the second frequency band that is different from the first sub-band.

A base station antenna, according to some embodiments herein, may include a reflector. The base station antenna may include first and second vertical columns of low-band radiating elements on a surface of the reflector and configured to transmit RF signals in a first frequency band. The base station antenna may include first, second, third, and fourth vertical columns of high-band radiating elements on the surface of the reflector and configured to transmit RF signals in a second frequency band that is higher than the first frequency band. The base station antenna may include a radome. The low-band radiating elements and the high-band radiating elements may be inside the radome, and the low-band radiating elements may extend forward from the surface of the reflector toward a front side of the radome. The base station antenna may include a low-band connector on a back side of the radome that is opposite the front side. The low-band connector may be electrically coupled to one or more of the low-band radiating elements. Moreover, the base station antenna may include a high-band connector that is on the back side of the radome and is electrically coupled to one or more of the high-band radiating elements.

In some embodiments, the second and third vertical columns of high-band radiating elements may be between, in a horizontal direction, the first and fourth vertical columns of high-band radiating elements. A low-band radiating element of the first vertical column of low-band radiating elements may be between, in a vertical direction that is perpendicular to the horizontal direction, first and second high-band radiating elements of the first vertical column of high-band radiating elements. A distance in the horizontal direction between a center of the low-band radiating element of the first vertical column of low-band radiating elements and a center of a low-band radiating element of the second vertical column of low-band radiating elements may be about 225 millimeters or narrower. Moreover, the low-band connector may be a 90-degree connector, and the high-band connector may be a blind mate connector.

DETAILED DESCRIPTION

Figure 1A:
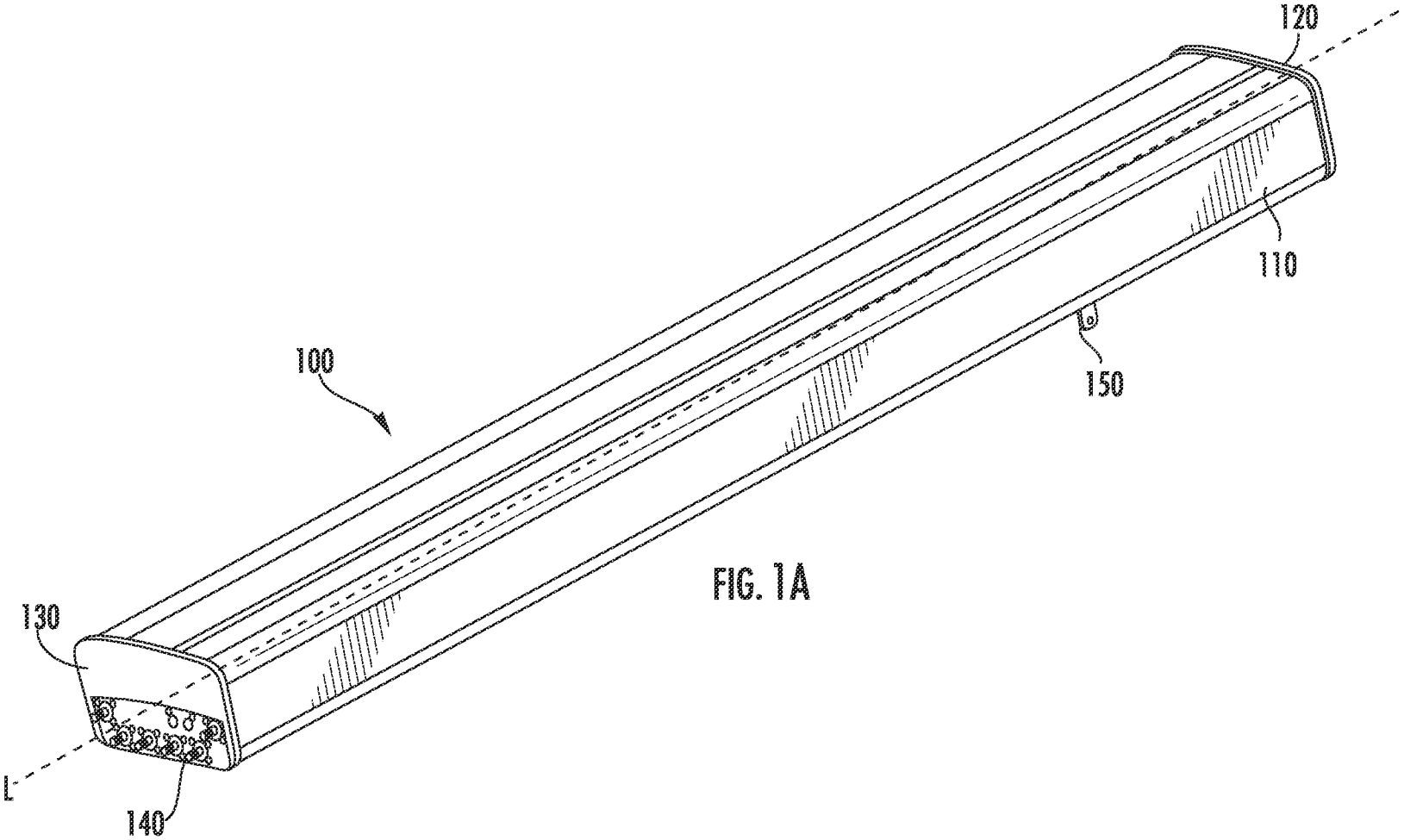
FIG. 1A is a front perspective view of a base station antenna according to embodiments of the present inventive concepts.

Pursuant to embodiments of the present inventive concepts, base station antennas for wireless communication networks are provided. The enhanced-capacity capability of massive MIMO techniques for wireless communication networks makes it desirable to deploy massive MIMO antenna arrays into the existing wireless infrastructure. A frequency band that is desirable for massive MIMO operation may include all or a portion of 1695-2180 megahertz (MHz). Other frequency bands that may be considered for massive MIMO operation are in the 2490-2690 MHz and 3300-3800 MHz frequency bands. Yet wireless service providers are faced with the challenge of adding additional antennas and radio heads onto existing towers to provide massive MIMO service in these frequency bands. Some of the challenges may include the lack of availability of mounting space for an additional base station antenna array or the additional wind loading that these base station antenna arrays would add to an existing tower. Because massive MIMO antenna arrays often comprise a large number of antenna elements, often 64 to 256 elements, these arrays can be quite large in size. Additionally, wireless service providers may incur additional lease charges from tower or building owners when adding an additional base station antenna array. Moreover, in many markets, municipal zoning restrictions limit the quantity or height of base station antennas, thus limiting the ability to add massive MIMO base station antenna arrays to provide enhanced-capacity capability.

According to embodiments of the present inventive concepts, however, high-band and low-band arrays may be integrated with each other. For example, some embodiments may provide a dual-band massive MIMO beamforming antenna integrated with two low-band arrays to deliver 16T16R massive MIMO in two high bands and 4T4R MIMO in a low band simultaneously. This integrated antenna solution adds capacity in both uplink and downlink and can provide coverage enhancement for 5G networks.

A base station antenna according to some embodiments may include additional elements (low band and high band) to support multi-user MIMO, beamforming, and typically 8 or 16 streams to enable a significant boost in network capabilities. Moreover, some embodiments may substantially increase spectral efficiency to deliver more network capacity and wider coverage and take LTE network performance to, or near, 5G levels.

Additionally or alternatively, some embodiments may provide connectors on the back side of a radome of a base station antenna rather than on an end of the radome, thus reducing the length of the antenna. Moreover, the horizontal spacing (e.g., center-to-center) between feed points of low-band radiating elements may, in some embodiments, be narrower than about 225 millimeters (mm), which may provide an antenna that is at least 10% smaller than conventional antennas.

Example embodiments of the present inventive concepts will be described in greater detail with reference to the attached figures.

FIG. 1A is a front perspective view of a base station antenna 100 according to embodiments of the present inventive concepts. As shown in FIG. 1A, the base station antenna 100 is an elongated structure and has a generally rectangular shape. In some embodiments, the width and depth of the base station antenna 100 may be fixed, and the length of the base station antenna 100 may be variable. For example, the base station antenna 100 may have a width of 432 mm, a depth of 208 mm, and a variable length (meaning that the base station antenna 100 can be ordered in different lengths).

The base station antenna 100 includes a radome 110. In some embodiments, the base station antenna 100 further includes a top end cap 120 and/or a bottom end cap 130. For example, the radome 110, in combination with the top end cap 120, may comprise a single unit, which may be helpful for waterproofing the base station antenna 100. The bottom end cap 130 is usually a separate piece and may include a plurality of connectors 140 mounted therein. The connectors 140 are not limited, however, to being located on the bottom end cap 130. Rather, one or more of the connectors 140 may be provided on the rear (i.e., back) side of the radome 110 that is opposite the front side of the radome 110.

In some embodiments, mounting brackets 150 may be provided on the rear side of the radome 110. The mounting brackets 150 may be used to mount the base station antenna 100 onto an antenna mount that is on, for example, an antenna tower. The base station antenna 100 is typically mounted in a vertical configuration (i.e., the long side of the base station antenna 100 extends along a vertical axis L with respect to Earth).

Figure 1B:
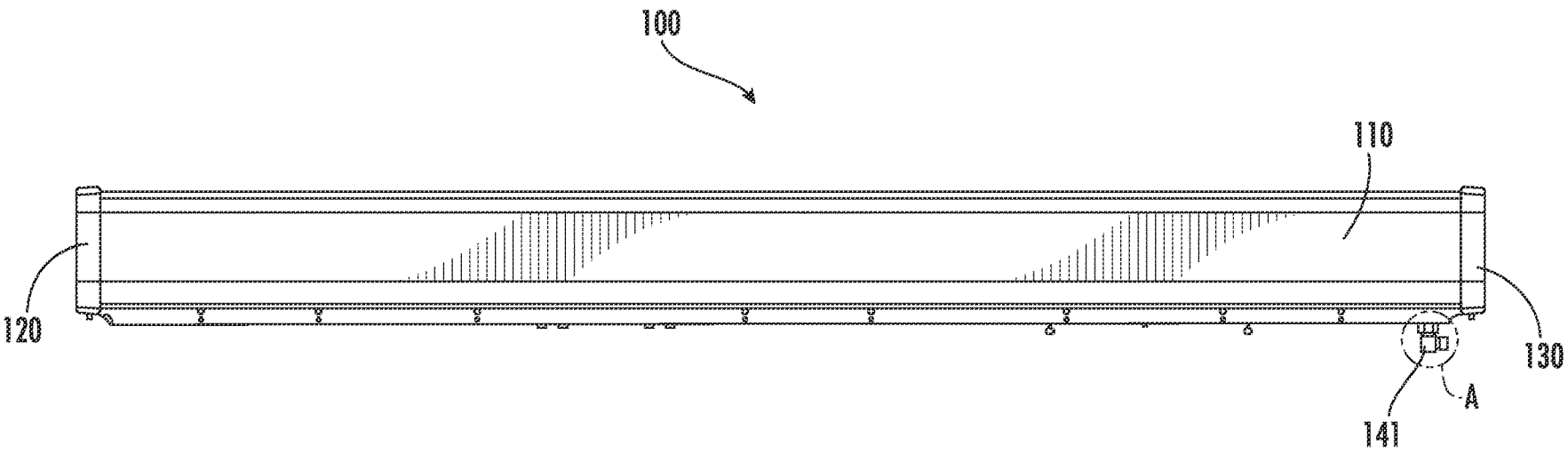
FIG. 1B is a side view of the base station antenna of FIG. 1A.

FIG. 1B is a side view of the base station antenna 100 of FIG. 1A. As shown in FIG. 1B, at least one connector 141 may be on the rear side of the radome 110. In particular, the connector(s) 141 may be on a portion A of the rear side of the radome 110 that is adjacent a bottom end of the antenna 100.

Figure 1C:
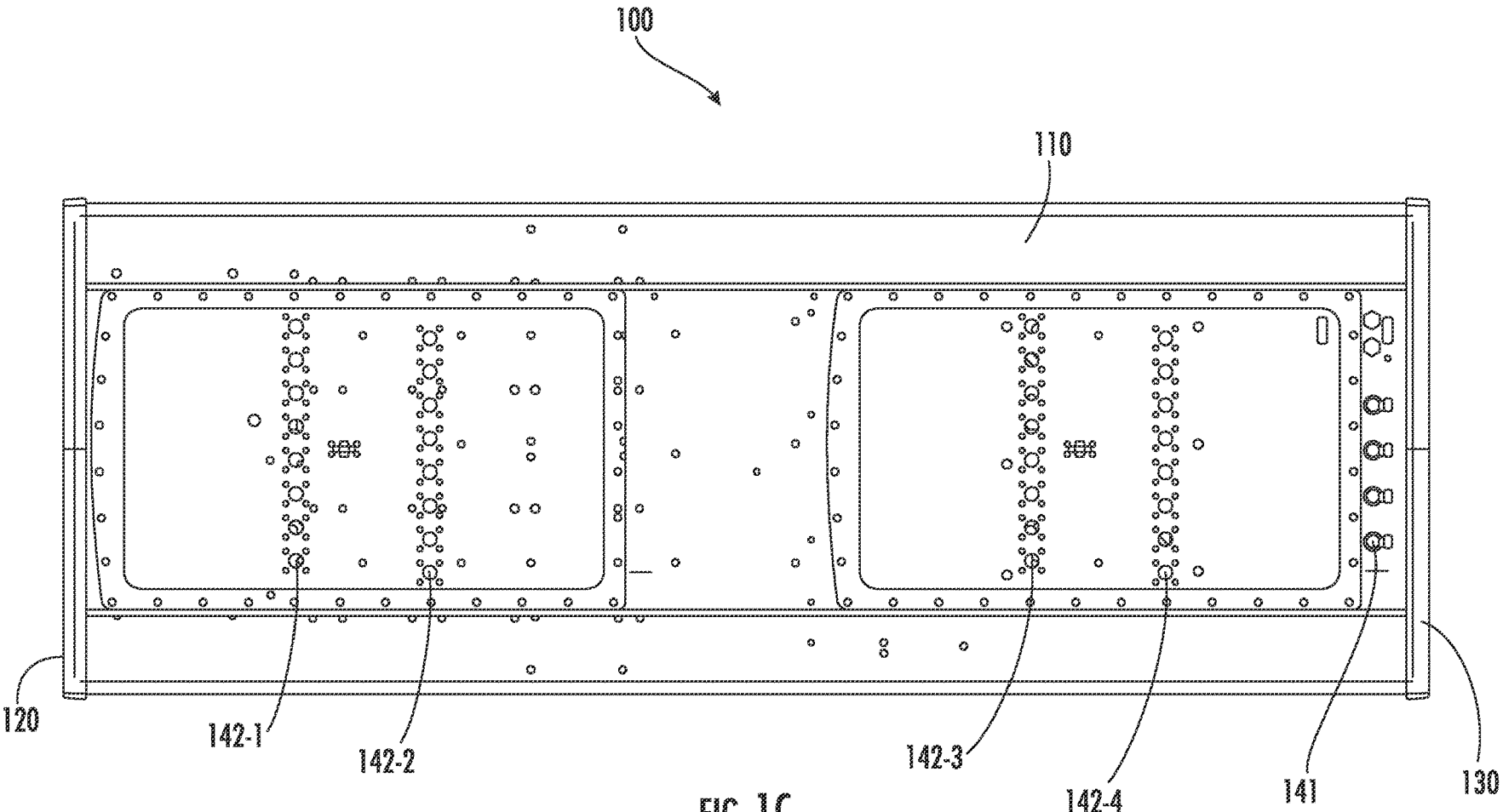
FIG. 1C is a rear view of the base station antenna of FIG. 1A.

FIG. 1C is a rear view of the base station antenna 100 of FIG. 1A. A plurality of connectors 141 may be on the rear side of the radome 110, such as at the portion A that is shown in FIG. 1B. Though the example of FIG. 1C illustrates a row that includes four of the connectors 141, more or fewer of the connectors 141 may be on the rear side of the radome 110. For example, the portion A may include one, two, three, four, five, six, or more of the connectors 141.

In addition to the connectors 141, the rear side of the radome 110 may include a plurality of connectors 142 that are different from the connectors 141. For example, connectors 142-1, 142-2, 142-3, and/or 142-4 may be in respective rows on the rear side of the radome 110. Each of the rows may include, for example, eight of the connectors 142, and may be between the connectors 141 and the top end of the antenna 100. In some embodiments, an upper connector group may include the connectors 142-1 and 142-2, and a lower connector group may include the connectors 142-3 and 142-4. Moreover, the connectors 141 and/or 142 may be connectors 140 (FIG. 1A) that are located on the rear side of the radome 110 instead of on the bottom end cap 130, thus reducing the vertical length (i.e., height) of the antenna 100. This may help the antenna 100 be within height limitations that are imposed in some jurisdictions.

Figure 2A:
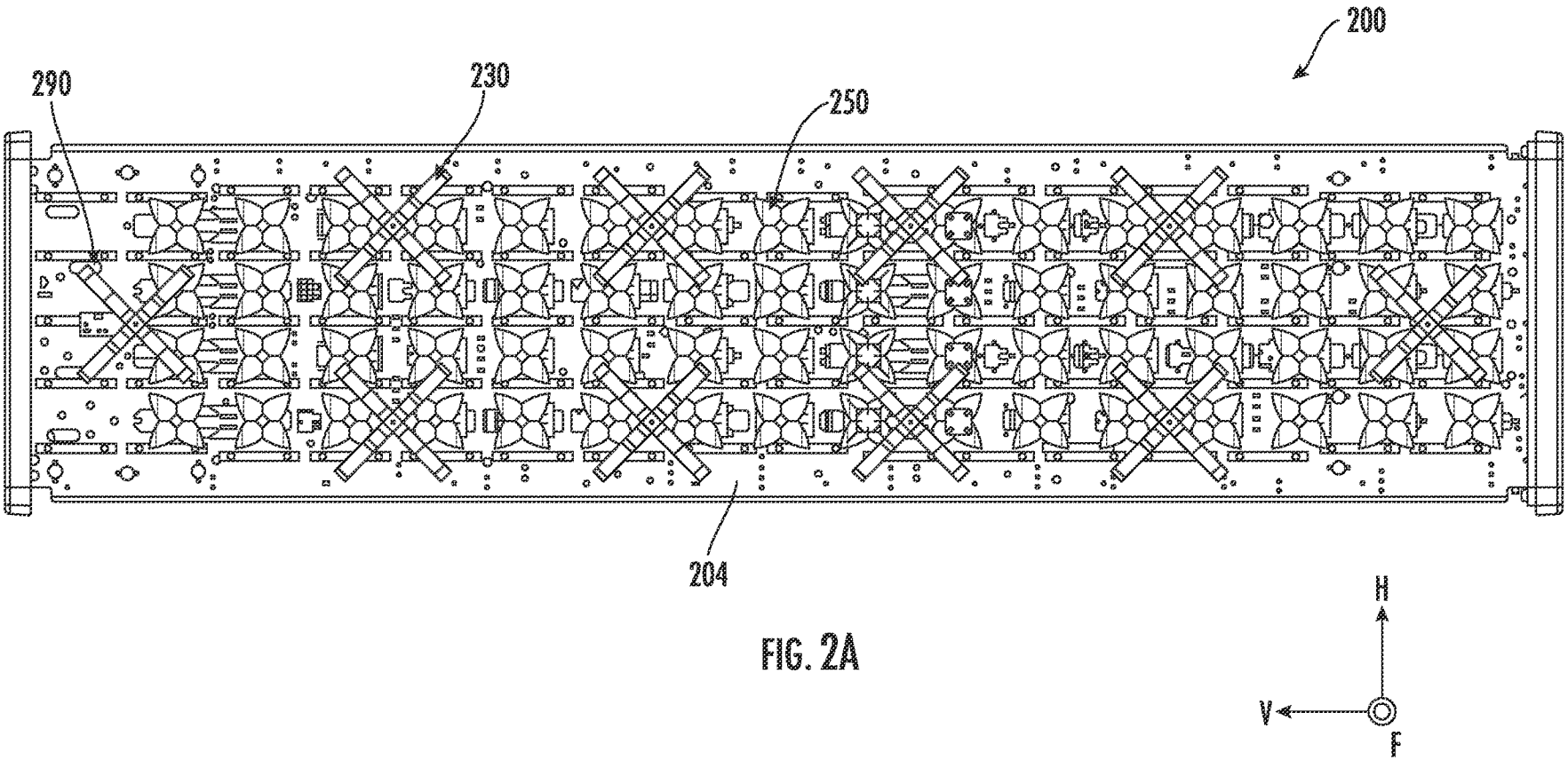
FIG. 2A is a front view of the base station antenna of FIG. 1A with the radome removed.

FIG. 2A is a front view of the base station antenna 100 of FIG. 1A with the radome 110 thereof removed to illustrate an antenna assembly 200 of the antenna 100. The antenna assembly 200 includes a plurality of low-band radiating elements 230 and a plurality of high-band radiating elements 250. The low-band radiating elements 230 may be grouped into one or more low-band arrays. The two vertical columns of low-band radiating elements 230 included in the low-band array(s) may be connected to a single radio to support 4T4R MIMO in the low band, or may be connected to multiple radios (e.g., to support service in both the 700 MHz and 800 MHz frequency bands). Similarly, the high-band radiating elements 250 may be grouped into one or more high-band arrays. For example, the high-band array(s) may be an 8T8R, 16T16R, 32T32R, 64T64R, 128T128R or higher array of the high-band radiating elements 250.

The vertical columns of high-band radiating elements 250 and the vertical columns of low-band radiating elements 230 may extend in a vertical direction V from a lower portion of the antenna assembly 200 to an upper portion of the antenna assembly 200. The vertical direction V may be, or may be in parallel with, the longitudinal axis L (FIG. 1A). The vertical direction V may also be perpendicular to a horizontal direction H and a forward direction F. The low-band radiating elements 230 and the high-band radiating elements 250 may extend forward in the forward direction F from one or more feeding boards 204. For example, the low-band radiating elements 230 and the high-band radiating elements 250 may, in some embodiments, be on the same feeding board 204. As an example, the feeding board 204 may be a single printed circuit board (PCB) having all of the low-band radiating elements 230 and all of the high-band radiating elements 250 thereon.

In some embodiments, the antenna assembly 200 may include one or more shared radiating elements 290. The shared radiating elements 290 may be provided in the center (in the horizontal direction H) of the antenna assembly 200 to advantageously maintain relative isolation between left and right columns of radiating elements (even when column-to-column spacing is narrow, as in FIG. 2A) and support reductions in Half Power Beam Width (HPBW) with increased azimuth directivity, thus improving a radiation pattern of the low-band radiating elements 230. For example, the shared radiating elements 290 may be centrally located and at the top and bottom of the antenna assembly 200, and may radiate at somewhat reduced power levels, to thereby advantageously improve the pattern of the low-band radiating elements 230. Examples of shared radiating elements are discussed in U.S. patent application Ser. No. 16/287,114, the disclosure of which is hereby incorporated herein by reference in its entirety.

In some embodiments, the radiating elements 230, 250, 290 may comprise dual-polarized radiating elements that are mounted to extend forwardly in the forward direction F from the feeding board(s) 204. Moreover, the low-band radiating elements 230 may each have a generally cloverleaf or pinwheel shape in some embodiments.

Figure 2B:
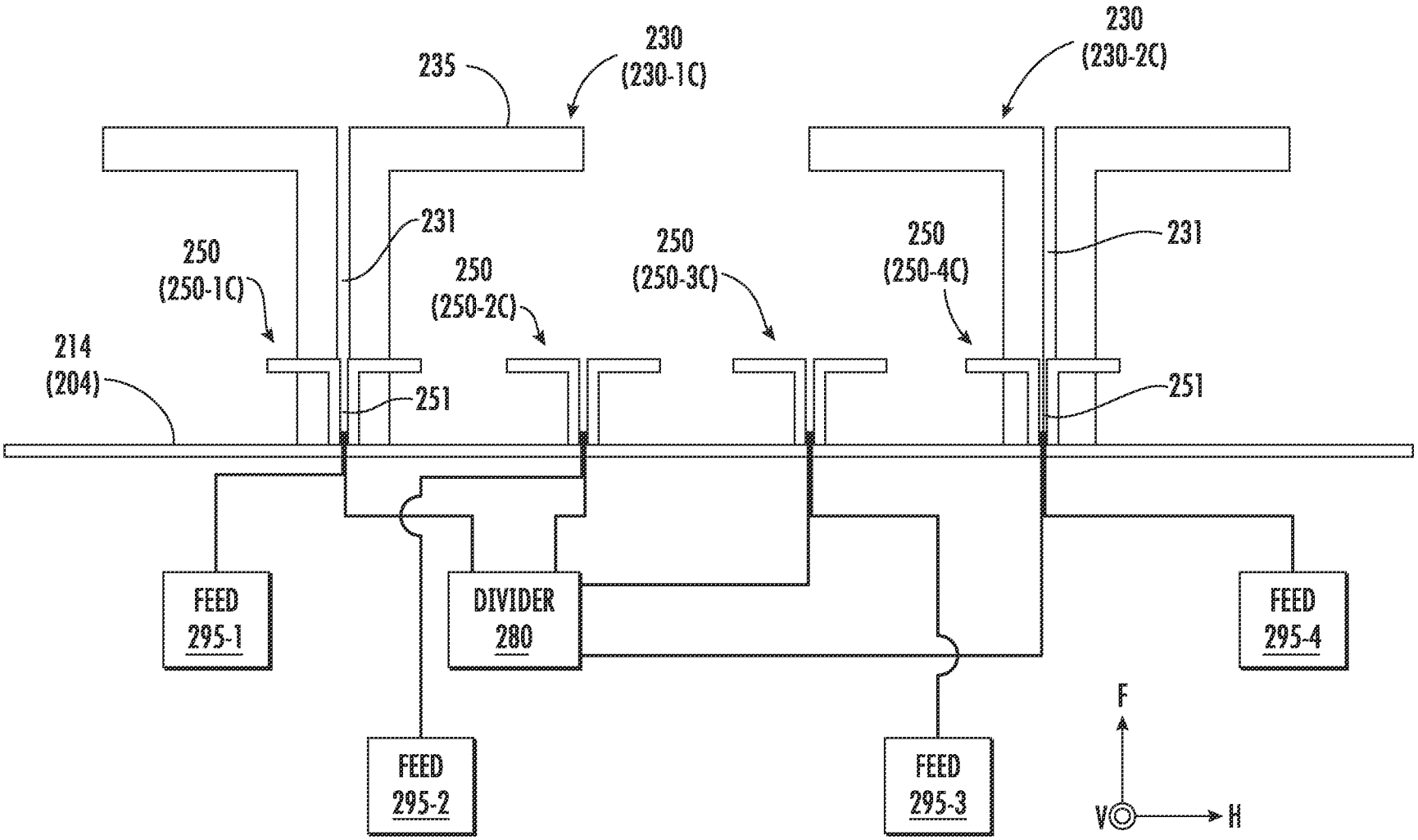
FIG. 2B is a schematic profile view of the high-band and low-band radiating elements of FIG. 2A.

FIG. 2B is a schematic profile view of the high-band radiating elements 250 and the low-band radiating elements 230 of FIG. 2A. The profile view shows a row of the low-band radiating elements 230 along the horizontal direction H. The low-band row includes a low-band radiating element 230 in a first outer vertical column 230-1C and a low-band radiating element 230 in a second outer vertical column 230-2C.

The profile view also shows a row of the high-band radiating elements 250 along the horizontal direction H. The high-band row includes high-band radiating elements 250 in respective outer vertical columns 250-1C and 250-4C, and high-band radiating elements 250 in respective inner vertical columns 250-2C and 250-3C. The outer vertical columns 250-1C and 250-4C are aligned in the vertical direction V with the outer vertical columns 230-1C and 230-2C, respectively. Accordingly, the inner vertical columns 250-2C and 250-3C are between feed points 231 of the outer vertical columns 230-1C and 230-2C in the horizontal direction H.

As shown in FIG. 2B, the high-band radiating elements 250 and the low-band radiating elements 230 may extend in the forward direction F from a ground plane reflector 214. The reflector 214 may be a surface of a feeding board 204 that is perpendicular to the forward direction F or may be a metallic sheet that is mounted on the feeding board 204 with cutouts for each radiating element 230, 250. The low-band radiating elements 230 may be sufficiently close to the high-band radiating elements 250 to have some overlap therebetween in the forward direction F. For example, a dipole arm 235 of a low-band radiating element 230 in the first outer vertical column 230-1C may overlap (i.e., overlie) a portion of one or more of the high-band radiating elements 250 in the forward direction F.

In some embodiments, the dipole arm 235 may have a length in (or at an angle of about 45 degrees with respect to) the horizontal direction H that is equal to about half of a wavelength at which the low-band radiating element 230 is configured to transmit. A conventional low-band radiating element, by contrast, may have a dipole length of about a full wavelength. The shorter length of the dipole arm 235 may help to provide a relatively compact antenna and may increase column isolation. Moreover, the dipole arm 235 may be a de-coupling arm having built-in invisibility at high-band frequencies to improve a radiation pattern of the high-band radiating elements 250.

The antenna assembly 200 (FIG. 2A) may include two vertical columns of low-band radiating elements 230 and four vertical columns of high-band radiating elements 250. Feed points 251 of a left outer (e.g., first) vertical column 250-1C of high-band radiating elements 250 may be aligned (or substantially aligned) in the vertical direction V with feed points 231 of a first outer vertical column 230-1C of low-band radiating elements 230. Similarly, feed points 251 of a right outer (e.g., fourth) vertical column 250-4C of high-band radiating elements 250 may be aligned (or substantially aligned) in the vertical direction V with feed points 231 of a second outer vertical column 230-2C of low-band radiating elements 230. The feed points 231 of the first outer vertical column 230-1C may thus be spaced apart from the feed points 231 of the second outer vertical column 230-2C in the horizontal direction H by the same distance (e.g., a non-zero distance of about 225 mm or narrower) as the feed points 251 of the outer first and fourth vertical columns 250-1C and 250-4C.

As used herein, the term "outer column" (or "outer vertical column") refers to a column that is not between, in the horizontal direction H, adjacent columns of that column type (e.g., high-band or low-band). The term "inner column" (or "inner vertical column"), by contrast, refers to a column that is between, in the horizontal direction H, adjacent columns of that column type. Also, the term "feed point" may refer to the center point of a radiating element. Moreover, the term "vertical" (or "vertically") refers to something (e.g., a distance, axis, or column) in the vertical direction V.

Various mechanical and electronic components of the antenna 100 may be mounted in a chamber behind a back side of the reflector surface 214. The components may include, for example, phase shifters, remote electronic tilt units, mechanical linkages, a controller, diplexers, and the like. The reflector surface 214 may comprise a metallic surface that serves as a reflector and ground plane for the radiating elements 230, 250, 290 of the antenna 100. Herein, the reflector surface 214 may also be referred to as the reflector 214.

In some embodiments, the base station antenna 100 (FIG. 1A) may include a fixed power divider 280 that is coupled to (e.g., electrically connected to) each of the four vertical columns 250-1C through 250-4C of high-band radiating elements 250. Distributing power from the power divider 280 to all of the high-band vertical columns can reduce the impact of coupling between the high-band vertical columns. Additionally or alternatively, each of the four vertical columns 250-1C through 250-4C may be individually (and thus independently) fed, such as by respective feed circuits 295-1 through 295-4. The power divider 280 and/or the feed circuits 295-1 through 295-4 may be on the front side on the feeding board(s) 204 or may be mounted in a chamber behind the back side of the feeding board(s) 204.

The low-band radiating elements 230 may be configured to be electromagnetically transparent within the 3300-3800 MHz band, and thus may not significantly impact the radiation or reception behavior of an array of the high-band radiating elements 250. Examples of radiating elements that are electromagnetically transparent to a different frequency band from that in which they are configured to transmit are discussed in Chinese Patent Application No. 201810971466.4, the disclosure of which is hereby incorporated herein by reference in its entirety.

One or more techniques for achieving electromagnetic transparency may be used for the low-band radiating elements 230. In some embodiments, a dipole arm 235 (FIG. 2B) of a low-band radiating element 230 that is configured to transmit RF energy in a first (e.g., low) frequency band is considered to be "transparent" to RF energy in a second, different (e.g., high) frequency band. For example, each dipole arm 235 may be implemented as a series of widened sections that are connected by intervening narrowed trace sections, so that each dipole arm 235 may act like a low pass filter circuit. Because the dipole arm 235 may be electromagnetically transparent to frequencies of the high-band radiating elements 250, the dipole arm 235 may be closer to, or even overlap/overlie (in the forward direction F), one or more high-band radiating elements 250. Moreover, this technique for achieving electromagnetic transparency may, in some embodiments, be combined with another technique/type of cloaking/electromagnetic transparency for the low-band radiating elements 230.

Figure 2C:
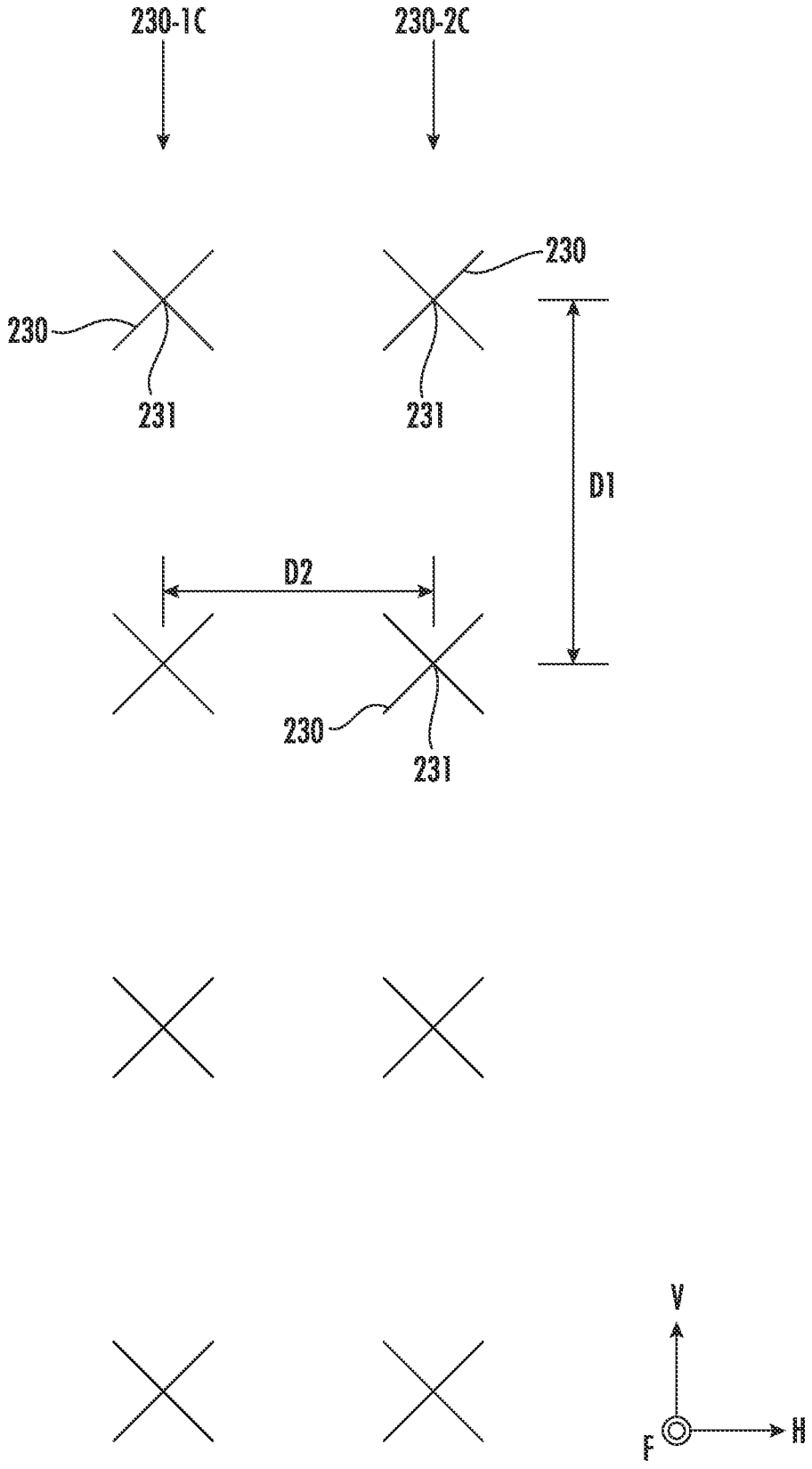
FIG. 2C is a schematic front view of the low-band radiating elements of FIG. 2A with the high-band radiating elements omitted.

FIG. 2C is a schematic front view of the low-band radiating elements 230 of FIG. 2A without the high-band radiating elements 250. For simplicity of illustration, FIG. 2C omits the high-band radiating elements 250 from view. A distance D1 in the vertical direction V between respective feed points 231 of consecutive low-band radiating elements 230 in the vertical column 230-2C (or in the vertical column 230-1C) may be about 0.5-1 of a wavelength of a frequency band in which the low-band radiating elements 230 are configured to transmit. Moreover, a distance D2 in the horizontal direction H between a feed point 231 of the vertical column 230-1C and a feed point 231 of the vertical column 230-2C may be about 225 mm or narrower.

Figure 2D:
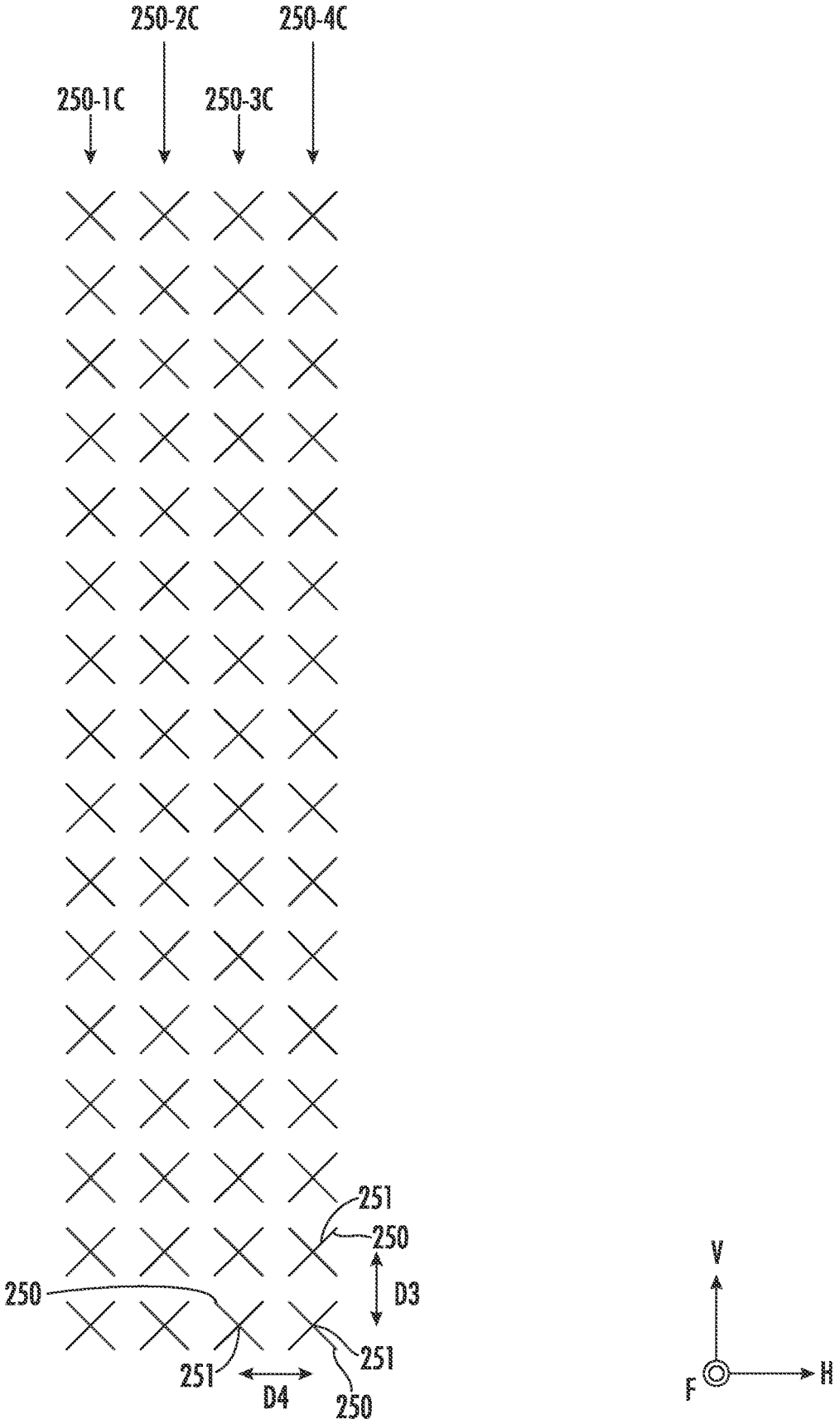
FIG. 2D is a schematic front view of the high-band radiating elements of FIG. 2A with the low-band radiating elements omitted.

FIG. 2D is a schematic front view of the high-band radiating elements 250 of FIG. 2A without the low-band radiating elements 230, which are omitted from view for simplicity of illustration. As shown in FIG. 2D, the vertical columns 250-1C through 250-4C may each comprise sixteen high-band radiating elements 250. Though sixteen high-band radiating elements 250 is given as an example, the number of high-band radiating elements 250 in a vertical column can be any quantity from two to twenty or more.

A distance D3 in the vertical direction V between respective feed points 251 of consecutive high-band radiating elements 250 in the vertical column 250-4C (or in one of the vertical columns 250-1C, 250-2C, or 250-3C) may be about 0.5-1 of a wavelength of a frequency band in which the high-band radiating elements 250 are configured to transmit. Moreover, a distance D4 in the horizontal direction H between a feed point 251 of the vertical column 250-3C and a feed point 251 of the adjacent vertical column 230-4C may be about 0.4-0.8 of the high-band wavelength.

By limiting the horizontal distance D2 (FIG. 2C) to about 225 mm or narrower for the low-band radiating elements 230, the base station antenna 100 (FIG. 1A) can fit in a compact space. For example, the relatively narrow width of the distance D2 may allow the overall width of the antenna 100 in the horizontal direction H to be about 432 mm or narrower. By contrast, conventional antennas may be wider than 490 mm, due to low-band vertical columns that are more than 250 mm apart from center to center. Accordingly, the antenna 100 can advantageously include two tightly-spaced vertical columns/arrays of low-band radiating elements 230 that are integrated alongside tightly-spaced vertical columns of high-band radiating elements 250. Moreover, though the antenna 100 may include as few as four vertical columns of high-band radiating elements 250, each of these vertical columns may include a large quantity (e.g., sixteen or more) of high-band radiating elements 250, and thus may provide enhanced-capacity capability to the antenna 100.

As shown in FIG. 2D, the vertical columns 250-1C through 250-4C may be non-staggered relative to each other. Accordingly, consecutive ones of the vertical columns 250-1C through 250-4C include respective high-band radiating elements 250 that are aligned with each other in the horizontal direction H.

Figure 2E:
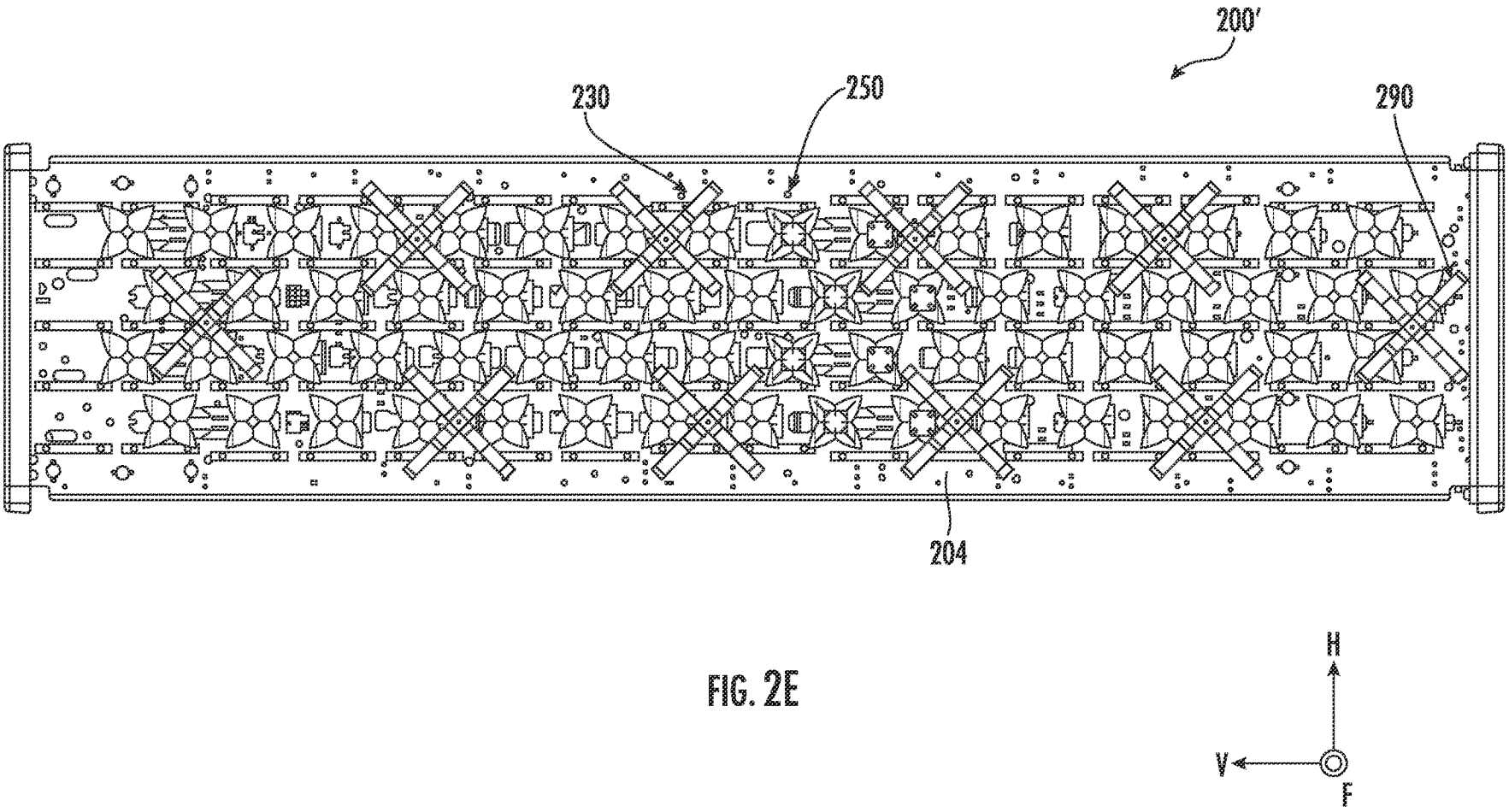
FIG. 2E is a front view of the base station antenna of FIG. 1A with the radome removed.

FIG. 2E is a front view of the base station antenna 100 of FIG. 1A with the radome 110 thereof removed to illustrate an antenna assembly 200' of the antenna 100. The antenna assembly 200' differs from the antenna assembly 200 (FIG. 2A), in that the antenna assembly 200' includes staggered low-band radiating elements 230 and/or staggered high-band radiating elements 250. Though the high-band group and/or the low-band group may be internally staggered, a feed point 231 (FIG. 2F) of a vertical column 230-2C may be aligned in the horizontal direction H with a feed point 251 (FIG. 2G) of an adjacent vertical column 250-3C.

Staggered arrangements of radiating elements may result in better radiation patterns than non-staggered arrangements. Staggered arrangements, however, may provide skew in the azimuth pattern, where the skew depends upon the amount of downtilt applied to the antenna 100. This skew may be corrected by adjusting the phase as a function of downtilt, but if the radio lacks that ability, then patterns may be better at the ends of the downtilt range if a non-staggered arrangement is used.

Figure 2F:
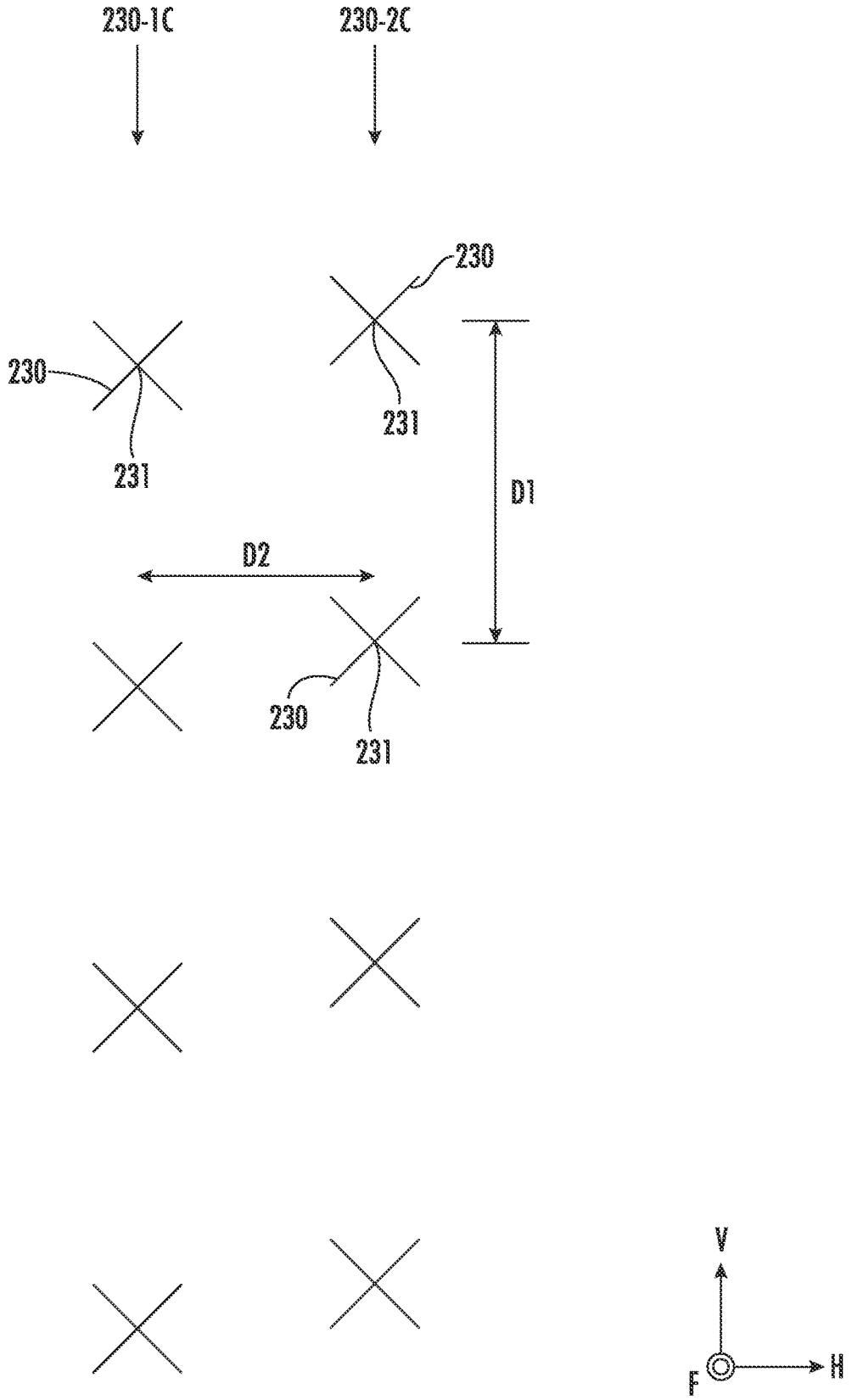
FIG. 2F is a schematic front view of the low-band radiating elements of FIG. 2E with the high-band radiating elements omitted.

FIG. 2F is a schematic front view of the low-band radiating elements 230 of FIG. 2E without the high-band radiating elements 250. For simplicity of illustration, FIG. 2F omits the high-band radiating elements 250 from view. As shown in FIG. 2F, the vertical column 230-1C may be staggered relative to the vertical column 230-2C. In particular, feed points 231 of the vertical column 230-1C may be staggered relative to (rather than aligned with) feed points 231 of the vertical column 230-2C.

Figure 2G:
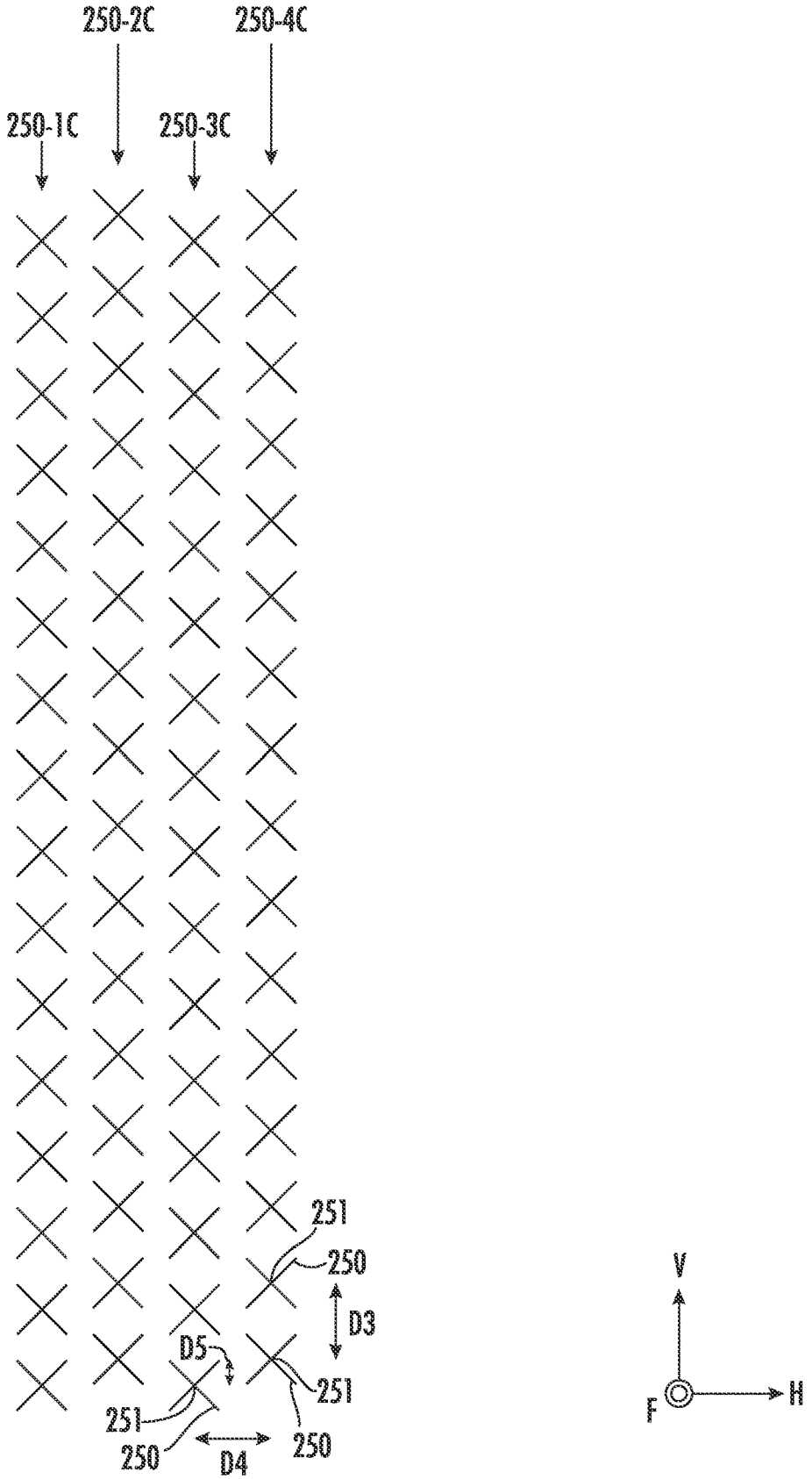
FIG. 2G is a schematic front view of the high-band radiating elements of FIG. 2E with the low-band radiating elements omitted.

FIG. 2G is a schematic front view of the high-band radiating elements 250 of FIG. 2E without the low-band radiating elements 230, which are omitted from view for simplicity of illustration. As shown in FIG. 2G, consecutive ones of the vertical columns 250-1C through 250-4C may be staggered relative to each other. Accordingly, a feed point 251 of the inner vertical column 250-3C may be staggered relative to a corresponding feed point 251 of the outer vertical column 250-4C in the vertical direction V by a distance D5, which may be about 0.2-0.4 of a wavelength of a frequency band in which the high-band radiating elements 250 are configured to transmit.

Figure 3A:
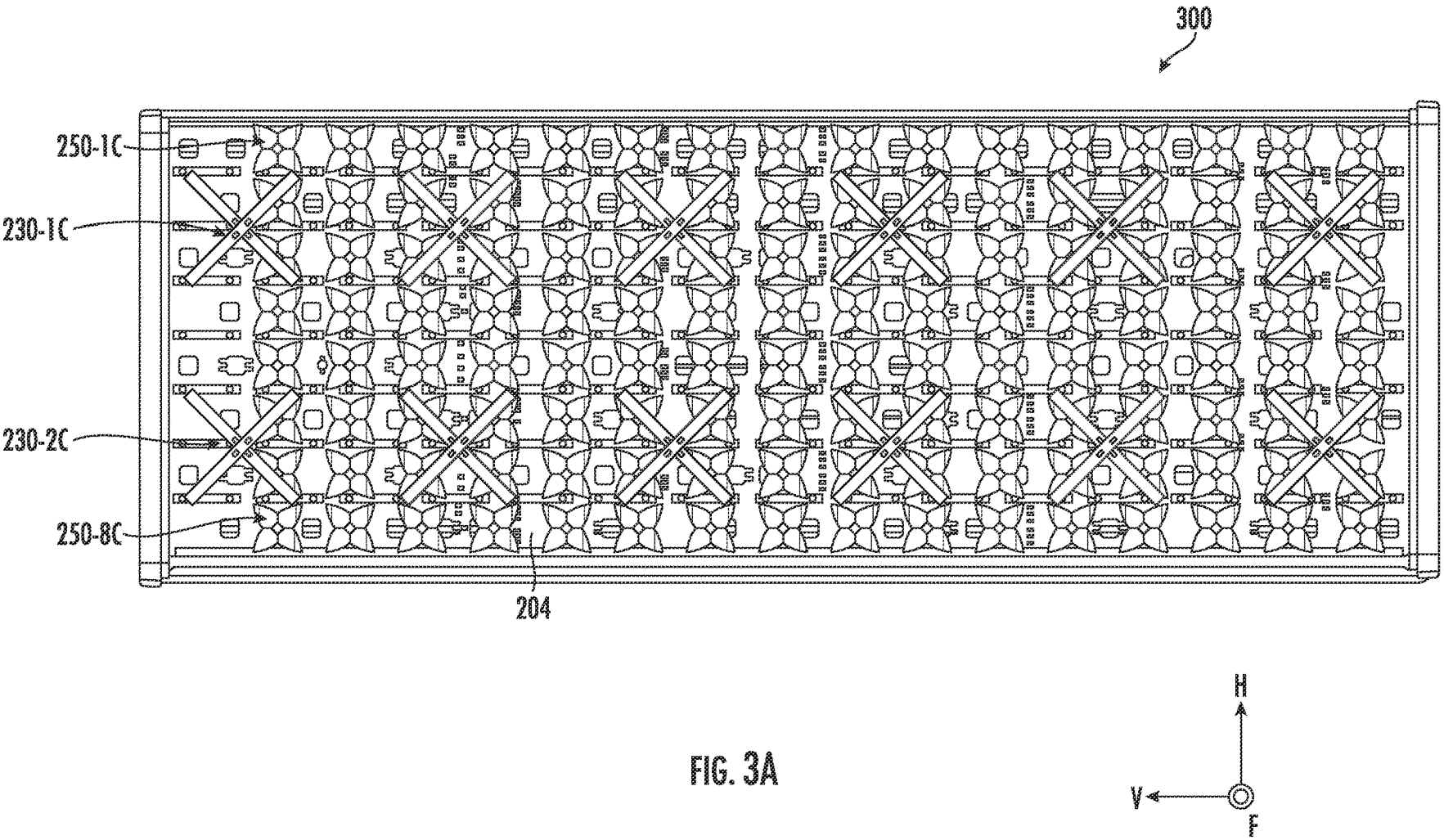
FIG. 3A is a front view of the base station antenna of FIG. 1A with the radome removed.

FIG. 3A is a front view of the base station antenna 100 of FIG. 1A with the radome 110 removed to illustrate an antenna assembly 300 of the antenna 100. The antenna assembly 300 includes a plurality of low-band radiating elements 230 and a plurality of high-band radiating elements 250. As shown in FIG. 3A, the low-band radiating elements 230 may be mounted in two vertical columns that may each extend along substantially the full length of the antenna 100 in some embodiments. Also, the high-band radiating elements 250 may be mounted in eight vertical columns that may each extend along substantially the full length of the antenna 100 in some embodiments. In some embodiments, however, the high-band radiating elements 250 may be in more (e.g., nine or more) or fewer (e.g., four, five, six, or seven) vertical columns. By including a large quantity (e.g., at least eight) of vertical columns of high-band radiating elements 250, the antenna 100 may have enhanced-capacity capability.

Figure 3B:
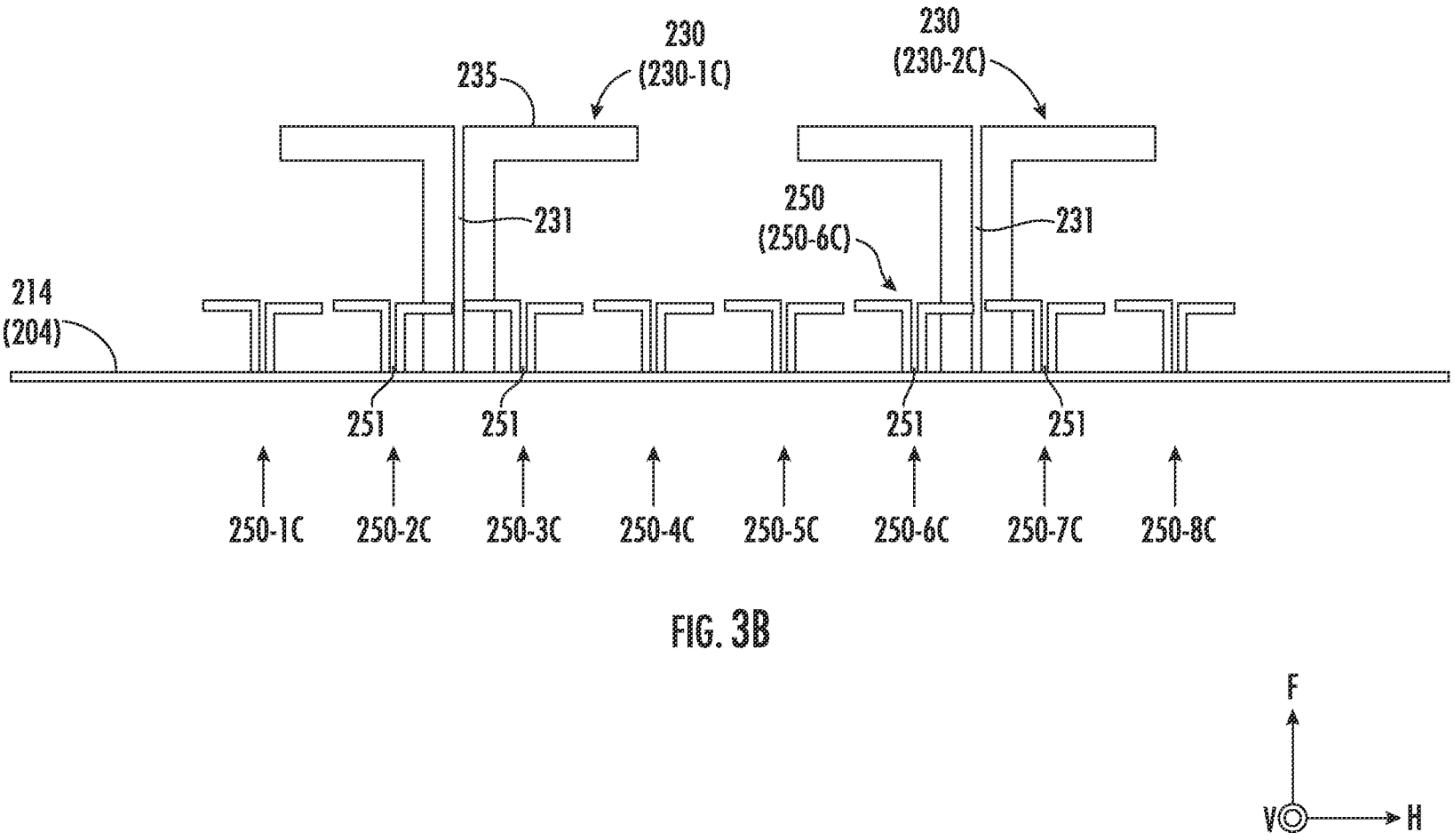
FIG. 3B is a schematic profile view of the high-band and low-band radiating elements of FIG. 3A.

FIG. 3B is a schematic profile view of the high-band radiating elements 250 and the low-band radiating elements 230 of FIG. 3A. The profile view shows a row of the low-band radiating elements 230 along the horizontal direction H. The low-band row includes a low-band radiating element 230 in a first outer vertical column 230-1C and a low-band radiating element 230 in a second outer vertical column 230-2C. The profile view also shows a row of the high-band radiating elements 250 along the horizontal direction H. The high-band row includes high-band radiating elements 250 in respective outer vertical columns 250-1C and 250-8C.

The outer vertical columns 250-1C and 250-8C may be farther outside on the reflector 214, in the horizontal direction H, than the outer vertical columns 230-1C and 230-2C, respectively. For example, a feed point 231 of the outer vertical column 230-1C may be between a feed point 251 of the vertical column 250-2C and a feed point 251 of the vertical column 250-3C. Likewise, a feed point 231 of the outer vertical column 230-2C may be between a feed point 251 of the vertical column 250-6C and a feed point 251 of the vertical column 250-7C. Vertical columns 250-3C through 250-6C may be between the outer vertical columns 230-1C and 230-2C.

Figure 3C:
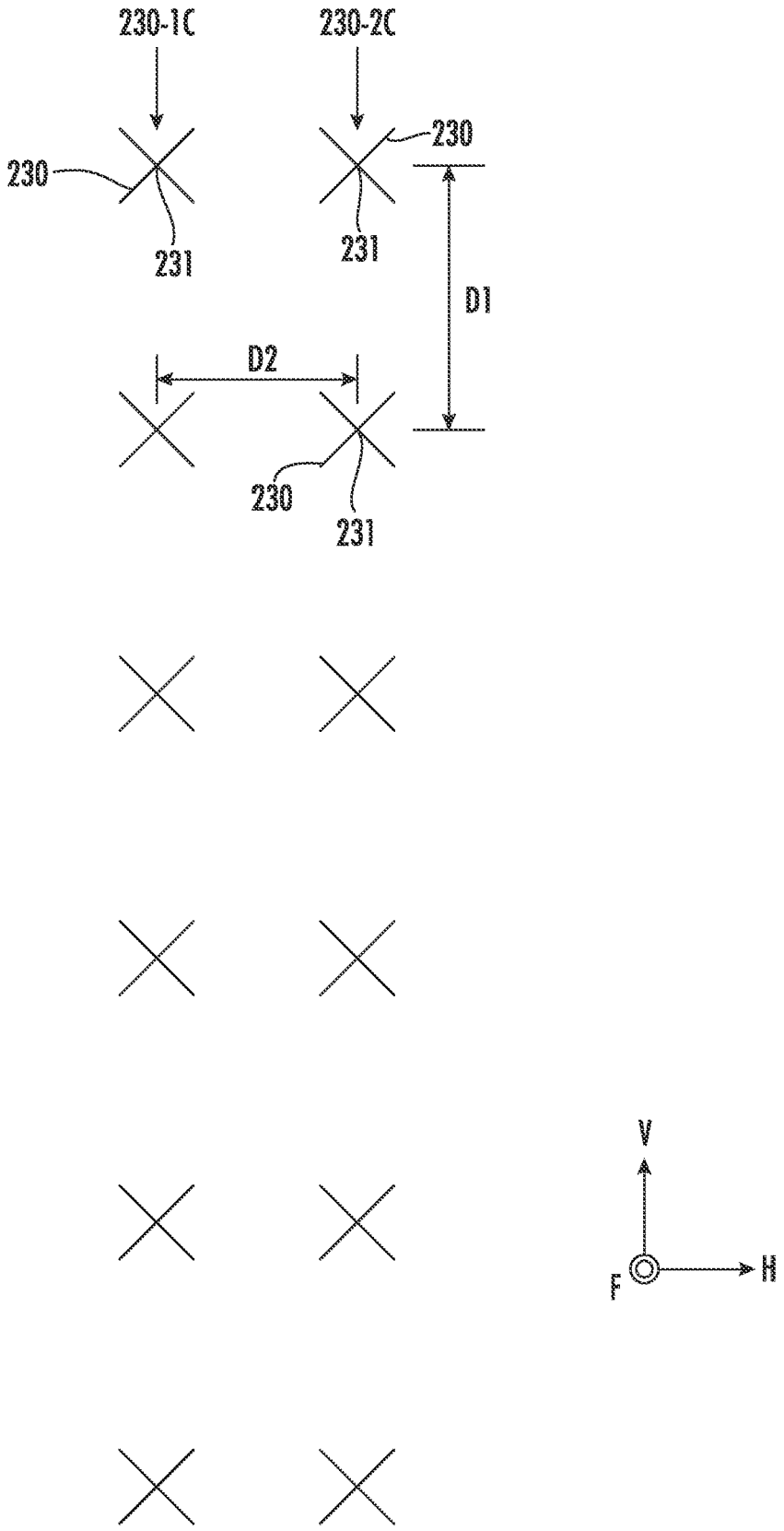
FIG. 3C is a schematic front view of the low-band radiating elements of FIG. 3A with the high-band radiating elements omitted.

FIG. 3C is a schematic front view of the low-band radiating elements 230 of FIG. 3A without the high-band radiating elements 250. For simplicity of illustration, FIG. 3C omits the high-band radiating elements 250 from view. A distance D1 in the vertical direction V between respective feed points 231 of consecutive low-band radiating elements 230 in the vertical column 230-2C (or in the vertical column 230-1C) may be about 0.5-1 of a wavelength of a frequency band in which the low-band radiating elements 230 are configured to transmit. Moreover, a distance D2 in the horizontal direction H between a feed point 231 of the vertical column 230-1C and a feed point 231 of the vertical column 230-2C may be about 0.4-0.8 of the low-band wavelength. In some embodiments, the group of low-band radiating elements 230 may cover frequencies including 600, 700, and/or 800 MHz.

Figure 3D:
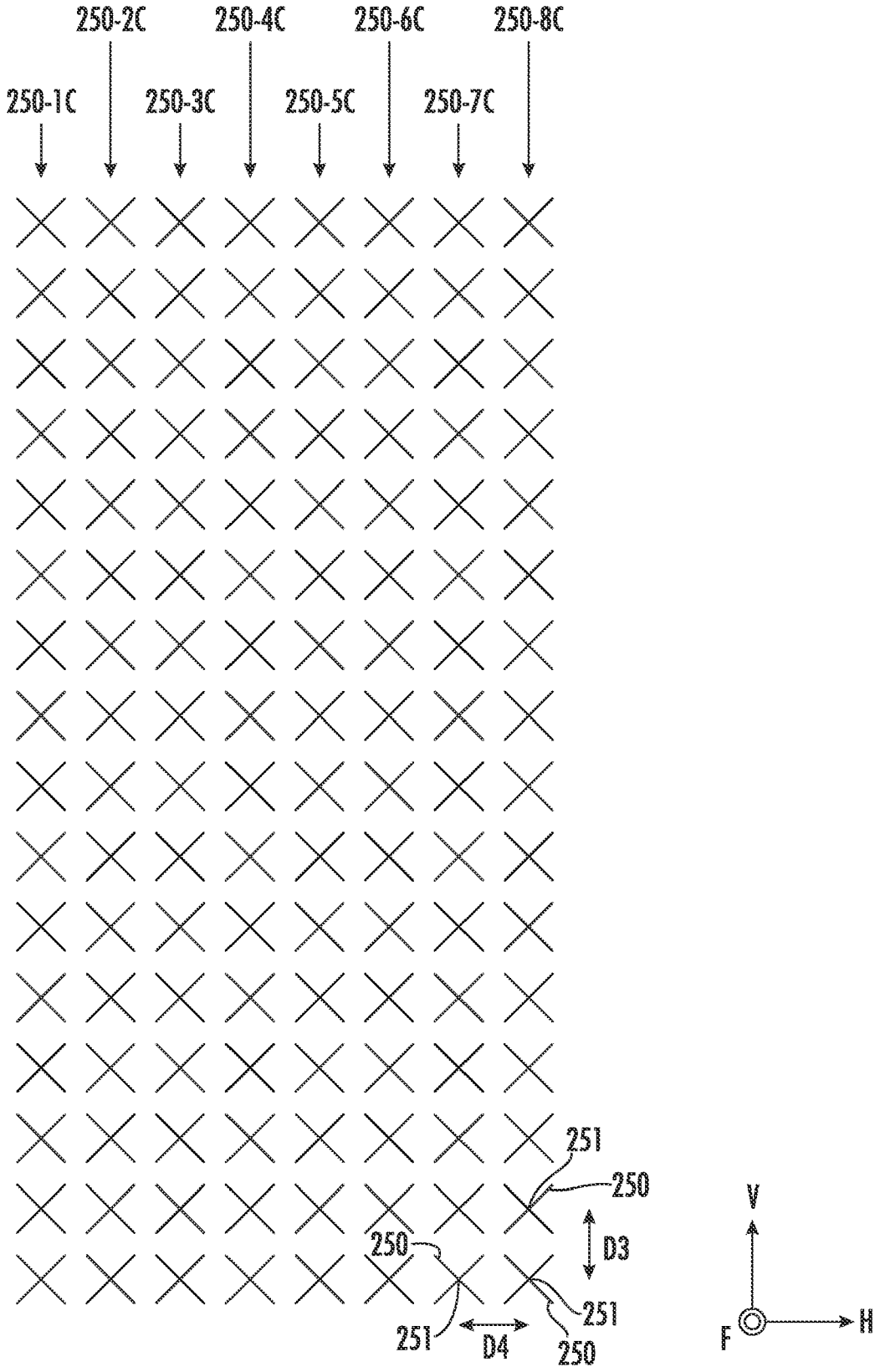
FIG. 3D is a schematic front view of the high-band radiating elements of FIG. 3A with the low-band radiating elements omitted.

FIG. 3D is a schematic front view of the high-band radiating elements 250 of FIG. 3A without the low-band radiating elements 230, which are omitted from view for simplicity of illustration. The eight vertical columns 250-1C through 250-8C may each comprise equal quantities of high-band radiating elements 250. For example, as shown in FIG. 3D, the vertical columns 250-1C through 250-8C may each comprise sixteen high-band radiating elements 250. Though sixteen is given as an example, the number of high-band radiating elements 250 in a vertical column can be any quantity from two to twenty or more.

A distance D3 in the vertical direction V between respective feed points 251 of consecutive high-band radiating elements 250 in the vertical column 250-8C (or in another one of the vertical columns) may be about 0.5-1 of a wavelength of a frequency band in which the high-band radiating elements 250 are configured to transmit. Moreover, a distance D4 in the horizontal direction H between a feed point 251 of the vertical column 250-7C and a feed point 251 of the adjacent vertical column 230-8C may be about 0.4-0.8 of the high-band wavelength.

Figure 3E:
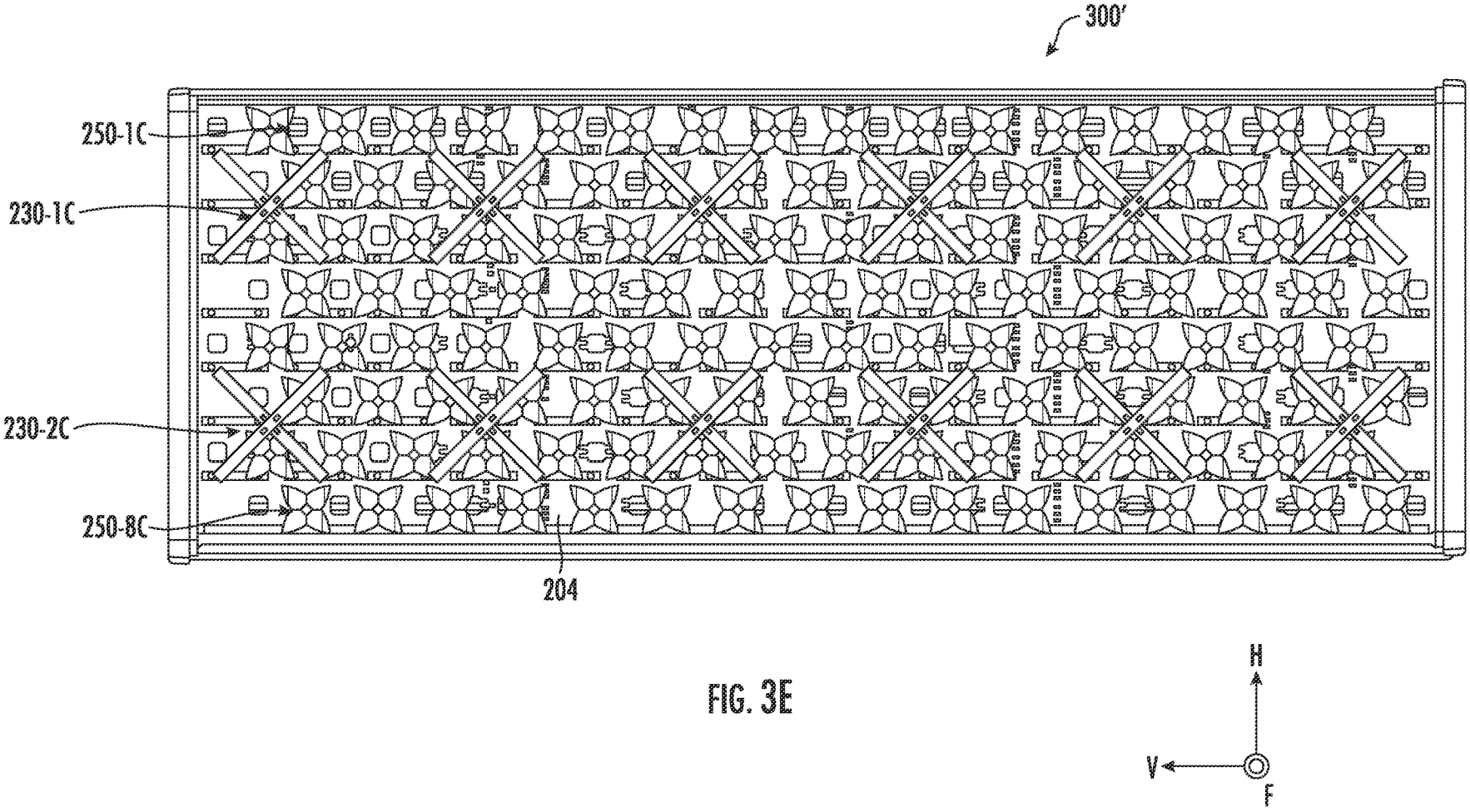
FIG. 3E is a front view of the base station antenna of FIG. 1A with the radome removed.

FIG. 3E is a front view of the base station antenna 100 of FIG. 1A with the radome 110 thereof removed to illustrate an antenna assembly 300' of the antenna 100. The antenna assembly 300' differs from the antenna assembly 300 (FIG. 3A), in that the antenna assembly 300' may include a staggered array of low-band radiating elements 230 and/or a staggered array of high-band radiating elements 250.

Figure 3F:
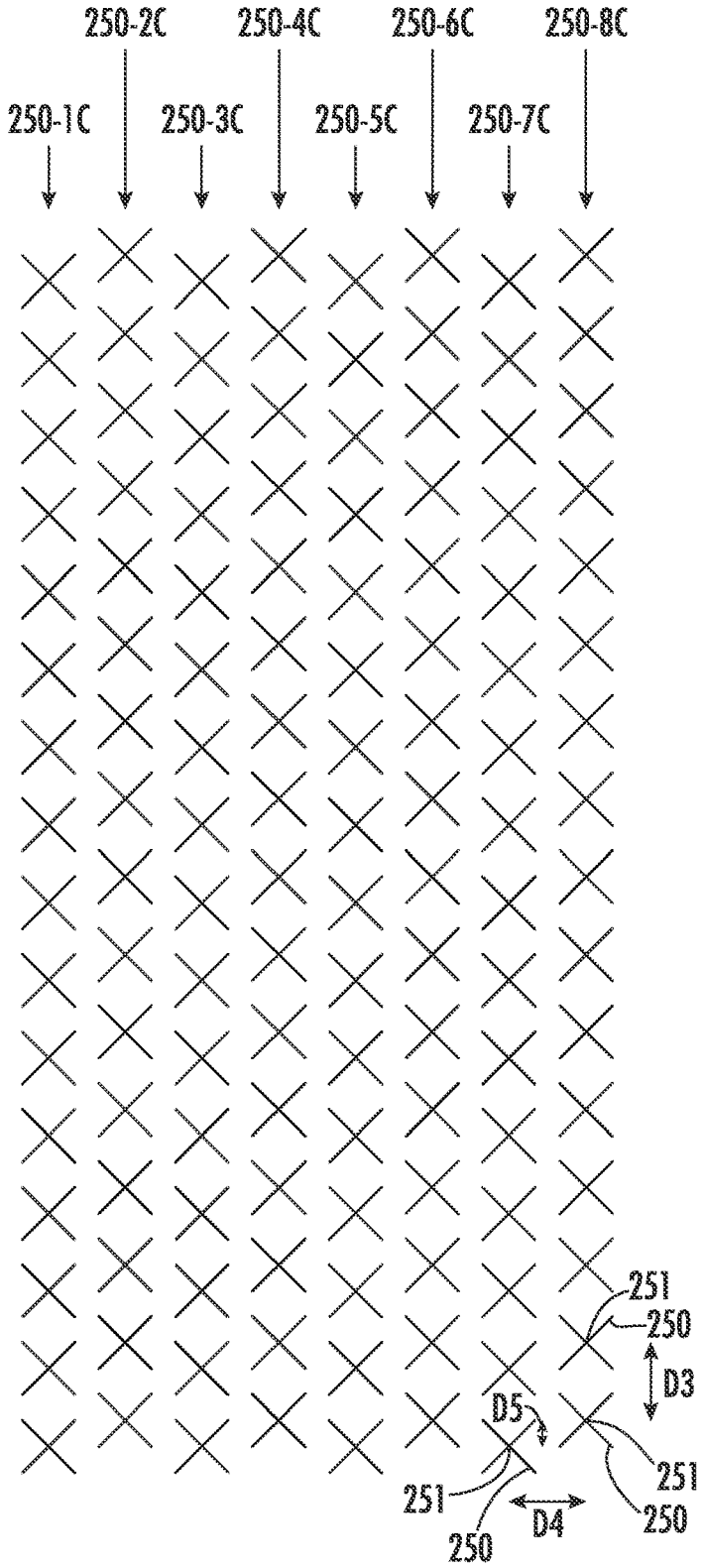
FIG. 3F is a schematic front view of the high-band radiating elements of FIG. 3E with the low-band radiating elements omitted.
Figure 3F:
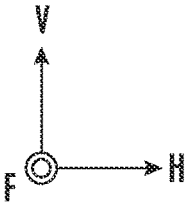

FIG. 3F is a schematic front view of the high-band radiating elements 250 of FIG. 3E without the low-band radiating elements 230, which are omitted from view for simplicity of illustration. As shown in FIG. 3F, consecutive ones of the vertical columns 250-1C through 250-8C may be staggered relative to each other. Accordingly, a feed point 251 of the inner vertical column 250-7C may be staggered relative to a corresponding feed point 251 of the outer vertical column 250-8C in the vertical direction V by a distance D5, which may be about 0.2-0.4 of a wavelength of a frequency band in which the high-band radiating elements 250 are configured to transmit.

Despite the staggering of the vertical columns 250-1C through 250-8C, the vertical columns 230-1C and 230-2C may be non-staggered relative to each other, as shown in FIG. 3E. In some embodiments, however, the vertical columns 230-1C and 230-2C may also be staggered.

The low-band radiating elements 230 of any of the antenna assemblies 200, 200', 300, and 300' according to embodiments herein may be configured to transmit and receive signals in a frequency band comprising the 617-896 MHz/694-960 MHz frequency range or a portion thereof. The high-band radiating elements 250 may be configured to transmit and receive signals in a frequency band comprising the 1400-2700 MHz/3300-4200 MHz/5100-5900 MHz frequency range or a portion thereof.

Different groups of the low-band radiating elements 230 may or may not be configured to transmit and receive signals in the same portion of a low frequency band. For example, in some embodiments, low-band radiating elements 230 in a first linear array may be configured to transmit and receive signals in the 700 MHz frequency band and low-band radiating elements 230 in a second linear array may be configured to transmit and receive signals in the 800 MHz frequency band. Alternatively, low-band radiating elements 230 in both linear arrays may be configured to transmit and receive signals in the 700 MHz (or 800 MHz) frequency band. Different groups/arrays of the high-band radiating elements 250 may similarly have any suitable configuration.

As noted above, the low-band radiating elements 230 may be arranged as two low-band linear arrays of radiating elements. Each linear array may be used to form a pair of antenna beams, namely an antenna for each of the two polarizations at which dual-polarized radiating elements are designed to transmit and receive RF signals.

The radiating elements 230, 250, 290 may be mounted on one or more feeding (or "feed") boards 204 that couple RF signals to and from the individual radiating elements 230, 250, 290. For example, all of the radiating elements 230, 250, 290 may be mounted on the same feeding board 204. Cables may be used to connect each feeding board 204 to other components of the antenna 100, such as diplexers, phase shifters, or the like.

In some embodiments, each connector 141 (FIGS. 1B and 1C) may be electrically coupled to one or more low-band radiating elements 230 of any of the antenna assemblies 200, 200', 300, and 300' according to embodiments herein. The connectors 141 may thus be referred to herein as "low-band connectors" or "low-band connection ports." Moreover, each connector 141 may be a bent (e.g., 90-degree/L-shaped) connector. Additionally or alternatively, each of the connectors 142 (FIG. 1C) may be a blind mate connector that is electrically coupled to one or more high-band radiating elements 250. The connectors 142 may thus be referred to herein as "high-band connectors" or "high-band connection ports."

The connectors 142-1 and 142-2 (FIG. 1C) may, in some embodiments, provide a first group of high-band connection ports that is electrically coupled to a first array of high-band radiating elements 250 of any of the antenna assemblies 200, 200', 300, and 300' according to embodiments herein. For example, the first high-band array may comprise ones of the high-band radiating elements 250 that are on an upper portion of the antenna 100 and that are configured to transmit RF signals in a first sub-band of a high frequency band. Likewise, the connectors 142-3 and 142-4 (FIG. 1C) may, in some embodiments, provide a second group of high-band connection ports that is electrically coupled to a second array of high-band radiating elements 250. For example, the second high-band array may comprise ones of the high-band radiating elements 250 that are on a lower portion of the antenna 100 and that are configured to transmit RF signals in a second sub-band of the high frequency band that is different from the first sub-band.

Because the high-band radiating elements 250 may provide a massive MIMO dual-band array with two different operating bands, two groups of the high-band radiating elements 250 may be electrically coupled to two groups of the connectors 142, respectively. The antenna 100 may thus also include a diplexer upstream of the signal transmission path.

Moreover, the connectors 142 may be blind mate connectors that are configured to electrically connect a Radio Remote Unit (RRU) to the dual-band array. The use of blind mate connectors may improve installation efficiency and system integration. As the RRU of the massive MIMO dual-band array may occupy significant space, it may be advantageous to use space-saving bent connectors (instead of blind mate connectors) as the connectors 141 for the low-band radiating elements 230 that are integrated alongside the massive MIMO dual-band array. Accordingly, the connectors 141 and the connectors 142 may be different respective types of connectors.

The arrangements of the high-band radiating elements 250 and the low-band radiating elements 230 according to embodiments of the present inventive concepts may provide a number of advantages. These advantages include integrating a large quantity of the high-band radiating elements 250 along with the low-band radiating elements 230. For example, an antenna assembly 300 or 300' may include eight vertical columns of high-band radiating elements 250 that are on a reflector surface 214 alongside (e.g., in parallel with) two vertical columns of low-band radiating elements 230. Such an integration of a large quantity of vertical columns of high-band radiating elements 250 alongside the low-band radiating elements 230 may provide enhanced-capacity capability to an antenna 100 while fitting in a compact space.

An antenna 100 may, in some embodiments, be even more compact by using a horizontal distance between feed points 231 of different vertical columns of low-band radiating elements 230 that is about 225 mm or narrower. To further facilitate a compact design, the quantity of vertical columns of high-band radiating elements 250 alongside the tightly-spaced low-band radiating elements 230 may be four, five, six, or seven instead of eight. Though the quantity of vertical columns of high-band radiating elements 250 may be as small as four (e.g., in an antenna assembly 200 or 200'), each of these vertical columns may include a large quantity (e.g., sixteen) of high-band radiating elements 250, thus providing enhanced-capacity capability to the antenna 100.

Moreover, connectors 141 and/or 142 may be provided on the rear side of a radome 110 of an antenna 100 rather than on a bottom end cap 130, to reduce the length of the antenna 100 in the vertical direction V. For example, the connectors 141 and/or 142 may not extend in the vertical direction V to, or below, a lowermost surface of the bottom end cap 130. Accordingly, the connectors 141 and/or 142, which may be electrically coupled to of any of the antenna assemblies 200, 200', 300, and 300', can help the antenna 100 fit in a compact space.

The present inventive concepts have been described above with reference to the accompanying drawings. The present inventive concepts are not limited to the illustrated embodiments. Rather, these embodiments are intended to fully and completely disclose the present inventive concepts to those skilled in this art. In the drawings, like numbers refer to like elements throughout. Thicknesses and dimensions of some components may be exaggerated for clarity.

Spatially relative terms, such as "under," "below," "lower," "over," "upper," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the example term "under" can encompass both an orientation of over and under. The device may be otherwise oriented (rotated 90 degrees or at other orientations) and the spatially relative descriptors used herein interpreted accordingly.

Herein, the terms "attached," "connected," "interconnected," "contacting," "mounted," and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the present inventive concepts. As used herein, the singular forms "a," "an," and "the" are intended to include the plural forms as well, unless the context clearly indicates otherwise. It will be further understood that the terms "comprises," "comprising," "includes," and/or "including" when used in this specification, specify the presence of stated features, operations, elements, and/or components, but do not preclude the presence or addition of one or more other features, operations, elements, components, and/or groups thereof.

That which is claimed is:

1. A base station antenna comprising:

a reflector;

a plurality of low-band radiating elements on a surface of the reflector and configured to transmit radio frequency ("RF") signals in a first frequency band; and eight vertical columns of high-band radiating elements on the surface of the reflector and configured to transmit RF signals in a second frequency band that is higher than the first frequency band, wherein a dipole arm of one of the low-band radiating elements overlies one of the high-band radiating elements in a direction that is perpendicular to the surface of the reflector, wherein the eight vertical columns of high-band radiating elements comprises first, second, third, fourth, fifth, sixth, seventh, and eighth vertical columns of high-band radiating elements that are arranged adjacent to one another in numerical order, and wherein a first of the low-band radiating elements is between, in a horizontal direction, the second and third vertical columns of high-band radiating elements, and a second of the low-band radiating elements is between, in the horizontal direction, the sixth and seventh vertical columns of high-band radiating elements.

2. The base station antenna of claim 1, wherein each of the eight vertical columns of high-band radiating elements comprises an equal quantity of high-band radiating elements.

3. The base station antenna of claim 2, wherein each of the eight vertical columns of high-band radiating elements comprises sixteen high-band radiating elements.

4. The base station antenna of claim 1, wherein a feed point of the one of the low-band radiating elements is staggered relative to a feed point of another one of the low-band radiating elements.

5. The base station antenna of claim 1, wherein the dipole arm of the one of the low-band radiating elements comprises a length equal to about half of a wavelength of the first frequency band, and wherein a feed point of the one of the low-band radiating elements is offset from a feed point of the one of the high-band radiating elements.

6. A base station antenna comprising:

a reflector;

a plurality of low-band radiating elements on a surface of the reflector and configured to transmit radio frequency ("RF") signals in a first frequency band; and four vertical columns of high-band radiating elements on the surface of the reflector and configured to transmit RF signals in a second frequency band that is higher than the first frequency band, wherein the four vertical columns of high-band radiating elements comprises first, second, third, and fourth vertical columns of high-band radiating elements that are arranged adjacent to one another in numerical order, wherein a first of the low-band radiating elements is between, in a horizontal direction, the second and third vertical columns of high-band radiating elements, and a second of the low-band radiating elements is aligned, in a vertical direction perpendicular to the horizontal direction, with the first or fourth vertical column of high-band radiating elements, wherein a dipole arm of the one of the low-band radiating elements overlies one of the high-band radiating elements in a direction that is perpendicular to the surface of the reflector, and wherein the dipole arm of the one of the low-band radiating elements comprises a length equal to about half of a wavelength of the first frequency band.

7. The base station antenna of claim 6, wherein feed points of a first of the four vertical columns of high-band radiating elements are staggered relative to feed points of a second of the four vertical columns of high-band radiating elements.

8. The base station antenna of claim 6, wherein each of the four vertical columns of high-band radiating elements is individually fed.

9. The base station antenna of claim 6, wherein a feed point of the one of the low-band radiating element is offset from a feed point of the one of the high-band radiating elements.

10. A base station antenna comprising:

a reflector;

a plurality of low-band radiating elements on a surface of the reflector and configured to transmit radio frequency ("RF") signals in a first frequency band;

first, second, third, and fourth vertical columns of high-band radiating elements on the surface of the reflector and configured to transmit RF signals in a second frequency band that is higher than the first frequency band; and a radome, wherein the low-band radiating elements and the high-band radiating elements are inside the radome, wherein the low-band radiating elements extend forward from the surface of the reflector toward a front side of the radome, wherein a first of the low-band radiating elements is aligned, in a vertical direction, with the first vertical column of high-band radiating elements or is between, in a horizontal direction that is perpendicular to the vertical direction, the first and fourth vertical columns of high-band radiating elements, wherein a feed point of the first of the low-band radiating antenna elements is offset relative to feed points of all of the high-band radiating elements of the first, second, third, and fourth vertical columns, wherein the second and third vertical columns of high-band radiating elements are between, in the horizontal direction, the first and fourth vertical columns of high-band radiating elements, and wherein the first of the low-band radiating elements is between and aligned with, in the vertical direction, first and second high-band radiating elements of the first vertical column of high-band radiating elements.

11. The base station antenna of claim 10, wherein a second of the low-band radiating elements is between, in the horizontal direction, the second and third vertical columns of high-band radiating elements.

12. The base station antenna of claim 10, wherein the first of the low-band radiating elements is between, in the horizontal direction, the first and fourth vertical columns of high-band radiating elements.

13. The base station antenna of claim 12, wherein a second of the low-band radiating elements is aligned, in the vertical direction, with the first vertical column of high-band radiating elements.

14. The base station antenna of claim 10, wherein the first of the low-band radiating elements is between, in the horizontal direction, the second and third vertical columns of high-band radiating elements.

15. The base station antenna of claim 14, wherein a feed point of the first of the low-band radiating elements is staggered relative to feed points of the second and third vertical columns of high-band radiating elements.

16. The base station antenna of claim 14, wherein a second of the low-band radiating elements is aligned, in the vertical direction, with the first vertical column of high-band radiating elements.

17. The base station antenna of claim 10, wherein the first low-band radiating antenna element includes a dipole arm that overlies at least one of the high-band radiating elements having feed point that is offset from the feed point of the first low-band radiating antenna element, and wherein the dipole arm has a length equal to about half a wavelength of the first frequency band.

* * * * *